US007540179B2

(12) United States Patent
Schlayer et al.

(10) Patent No.: US 7,540,179 B2
(45) Date of Patent: Jun. 2, 2009

(54) METHOD FOR PRODUCING LONGITUDINAL GROOVES IN CYLINDRICAL WORKPIECES

(75) Inventors: Dietmar Schlayer, Vogt (DE); Gerhard Manz, Leutkirch (DE); Hans-Joachim Pieperhoff, Wiesbaden (DE)

(73) Assignee: Mueller Weingarten AG, Weingarten (DE)

( * ) Notice: Subject to any disclaimer, the term of this patent is extended or adjusted under 35 U.S.C. 154(b) by 0 days.

(21) Appl. No.: 11/765,757

(22) Filed: Jun. 20, 2007

(65) Prior Publication Data

US 2007/0289349 A1 Dec. 20, 2007

Related U.S. Application Data

(63) Continuation of application No. PCT/DE2005/002136, filed on Nov. 26, 2005.

(30) Foreign Application Priority Data

Dec. 23, 2004 (DE) ..... 10 2004 063 477

(51) Int. Cl.
*B21B 27/00* (2006.01)

(52) U.S. Cl. ..... 72/102; 72/77; 72/370.2; 72/370.21

(58) Field of Classification Search ..... 72/67, 72/68, 82, 83, 84, 85, 102, 110, 111, 104, 72/108, 76, 77, 95, 98, 100, 212, 213, 370.2, 72/370.21

See application file for complete search history.

(56) References Cited

U.S. PATENT DOCUMENTS

| | | | | |
|---|---|---|---|---|
| 2,506,657 | A * | 5/1950 | Webster | 72/68 |
| 3,717,017 | A * | 2/1973 | Vukovich | 72/68 |
| 3,729,970 | A | 5/1973 | Propach et al. | |
| 4,697,445 | A * | 10/1987 | Tanaka et al. | 72/68 |
| 5,794,475 | A | 8/1998 | Schuppler et al. | |
| 5,806,358 | A * | 9/1998 | Rolf | 72/68 |
| 5,852,873 | A | 12/1998 | Pollkötter | |
| 6,161,409 | A * | 12/2000 | Friese | 72/110 |
| 6,370,776 | B1 * | 4/2002 | Kanemitsu et al. | 29/892 |
| 6,691,542 | B2 * | 2/2004 | Fukukawa et al. | 72/84 |
| 6,694,791 | B1 * | 2/2004 | Johnson et al. | 72/91 |
| 6,898,956 | B2 * | 5/2005 | Sato et al. | 72/111 |

FOREIGN PATENT DOCUMENTS

| | | |
|---|---|---|
| DE | 20 17 709 A1 | 11/1971 |
| DE | 25 49 230 A1 | 9/1976 |
| DE | 28 29 041 A1 | 1/1980 |
| DE | 41 40 720 A1 | 6/1993 |
| DE | 196 02 298 A1 | 8/1996 |
| DE | 196 36 565 A1 | 3/1997 |
| DE | 197 42 818 A1 | 4/1999 |
| JP | 62-088522 A1 | 4/1987 |

* cited by examiner

*Primary Examiner*—Edward Tolan
(74) *Attorney, Agent, or Firm*—Burr & Brown

(57) ABSTRACT

The invention relates to a method for producing longitudinal grooves in cylindrical workpieces using a rolling deformation method preceded by a performing method.

11 Claims, 7 Drawing Sheets

METHOD FOR PRODUCING LONGITUDINAL GROOVES IN CYLINDRICAL WORKPIECES

CROSS REFERENCE TO RELATED APPLICATIONS

This application is a continuation of International Application No. PCT/DE2005/002136, filed Nov. 26, 2005, and claims the benefit under 35 USC §119(a)-(d) of German Application No. 10 2004 063 477.7, filed Dec. 23, 2004, the entireties of which are incorporated herein by reference.

FIELD OF THE INVENTION

The invention relates to a method for producing longitudinal grooves in cylindrical workpieces, in which the actual rolling operation is preceded by a preforming stage.

BACKGROUND OF THE INVENTION

During the manufacturing of profiled bodies, such as, for example, multi-disk supports of clutches, crown gears or similar workpieces with a cylindrical basic structure, high degrees of accuracy and precision are frequently required. In particular, the accuracy and surface quality are what matter.

The workpieces described are mass-produced articles which are produced in large piece numbers. In addition to the qualitative features, the costs and yield are therefore also important criteria in a production installation for workpieces of this type.

DE 25 49 230 A1 discloses a method with which parts, as have been described above, can be produced. This method is termed the "Grob method" in deforming technology and tool manufacturing spheres. In this method, with a relatively thin-walled, hollow workpiece, both an internal profile and an external profile can be produced. For this purpose, the blank is drawn onto an arbor corresponding to the internal profile. In this state, the workpiece undergoes a feed motion, in which it is displaced along its workpiece axis and is rotated about the workpiece axis. During this feed motion of the workpiece, the workpiece is worked from the outside by ring-like, profiled rolls, said rolls, matched to the division of the profile and the feed motion of the workpiece, carrying out sudden individual rolling operations in a rapid sequence. These individual rolling operations are carried out in the same direction of rotation, which primarily runs in the longitudinal direction of the profile. The individual rolling operations following one another in the same tooth space in the longitudinal direction of the profile overlap with regard to their engagement on the workpiece. The disadvantage of this Grob method is that it cannot be integrated into a machining line with further deformation operations. Mechanization in time with the other deformation stages is not possible.

An alternative method is described in DE 20 17 709 A1. A special rolling tool makes it possible to produce the workpiece from a blank with a smooth external contour by means of a press, with each stroke of the press forming a workpiece from a blank. During each stroke of the press, a rolling operation takes place, in which the profiled rollers press the desired external profile into the circumferential surface of the workpiece. In this case, the profiled rollers are arranged in a lower die along the circumference of the workpiece to be machined. If the workpiece is pressed between the rollers by means of an upper die, which is fastened to the ram of the press, said rollers are supported on supporting rollers with appropriate mounting.

The lower die can be constructed in a rotationally symmetrical manner, with the individual profiled rollers which produce the profile of the workpiece being distributed regularly and at a uniform angle with respect to one another along the circumference of the workpiece. As a consequence of this and as a consequence of the rotationally symmetrical distribution of forces which arises during a deforming operation, the individual grooves produced by the respective profiled rollers are practically identical to one another. In particular, a step-free external contour is achieved.

The disadvantage of this method is that, for example, during the rolling deformation of an external toothing, when the profiled roller is moved into the material, a zone is produced in which the tooth face is not completely formed. This effect is caused technologically and cannot be avoided even by changing process parameters.

SUMMARY OF THE INVENTION

The invention is based on the object of developing a method for deforming a rotationally symmetrical, cup-shaped blank, in which a high degree of filling of the toothing face and therefore an increase in the usable toothing length in the bottom region are achieved. Furthermore, the method is to be able to be integrated cost-effectively into an automatic deformation process line.

The invention is based on the concept of improving the rolling deformation result by, in a preforming stage, material being accumulated at a point of the blank at which, during the actual rolling deformation, the profiled rollers dip into the material. The effect achieved by this preforming of the blank in the region of the toothing is that percentage contact areas of the profile which were hitherto not achievable and corresponding sheet-metal thicknesses for the subsequent rolling deformation method can be obtained.

The preforming or else the placing of the blank material for the corresponding shaping in the tooth region is used for the further rolling deformation in a specific manner in line with the result to be achieved. The aim is, firstly, to realize the degree of deformation in the case of thick metal sheets, and to optimize the degree of filling of the toothing. The type of preforming or the material accumulation has to be matched and adapted individually to the corresponding component in order to achieve an optimum result for the toothing. In the preforming stage, the material is accumulated preferably at the upper end, in the end region of the cup-shaped blank, at the point at which, in the rolling deformation stage, the profiled rollers begin with the engagement of the material. The amount and the shape of the material accumulation are decisive for the later deformation result. In particular in the case of external toothings, particular importance is attached to the preforming. The material accumulation has to be configured in such a manner that, after the rolling deformation, the degree of filling of the tooth face is as high as possible. That is to say, the effect which occurs when dipping of the profiled rollers into the blank material, namely that the deformed material on the first deformed section is pushed in front of the profiled rollers, is compensated for by precisely the correct amount of material being accumulated before the dipping phase of the profiled rollers. Ideally, the tooth face is completely filled as a result. The shape of the preformed blank can be determined both by computer-assisted calculating methods and also empirically by trials. Various methods can be used to produce the preform. For example, stamping, precompression or else rolling deformation in the opposite direction are conceivable. During the selection of the preforming method, it is advantageous if it, like the rolling deformation, can be integrated into an automated deformation pressing line. It is precisely therein that the rolling deformation has a crucial advantage over competing methods. While the rolling deformation takes place on a conventional deformation press, independent deformation machines have to be provided for other methods, such as, for example, in the Grob method, which deformation machines cannot readily be coupled to an automated workpiece transportation of a deformation line.

BRIEF DESCRIPTION OF THE DRAWINGS

Further individual parts and advantages of the invention emerge from the exemplary embodiment illustrated with reference to the drawings, in which:

FIG. 4 shows the blank after the segments are stamped on;

DETAIL DESCRIPTION OF THE INVENTION

Figure 1:
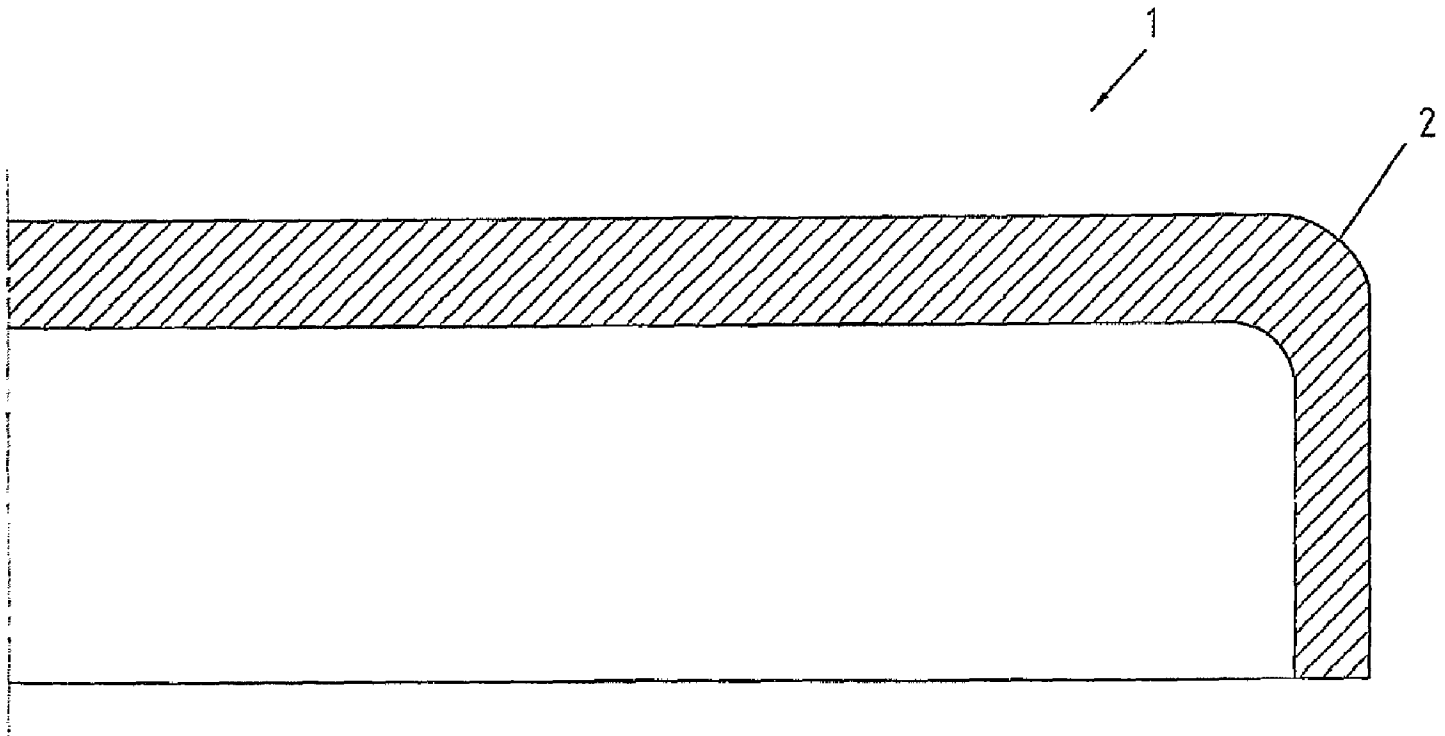
FIG. 1 shows a half section of a blank.

In FIG. 1, the blank 1 can be seen in the state in which it is supplied to the method according to the invention. At this stage, the blank 1 already has a number of processing operations behind it. After cutting out of a molded billet, subsequent drawing and ironing has resulted in a cup-shaped, rotationally symmetrical blank, as depicted in FIG. 1. This still has points in the corner region at which there are non-perpendicular, non-tangential transitions. In addition, there is too little material in the corner region 2 in order to obtain a good result during a subsequent deformation operation. In the method according to the invention, first of all the blank 1 is deformed by compression in such a manner that material is accumulated in the corner region 2.

Figure 2:
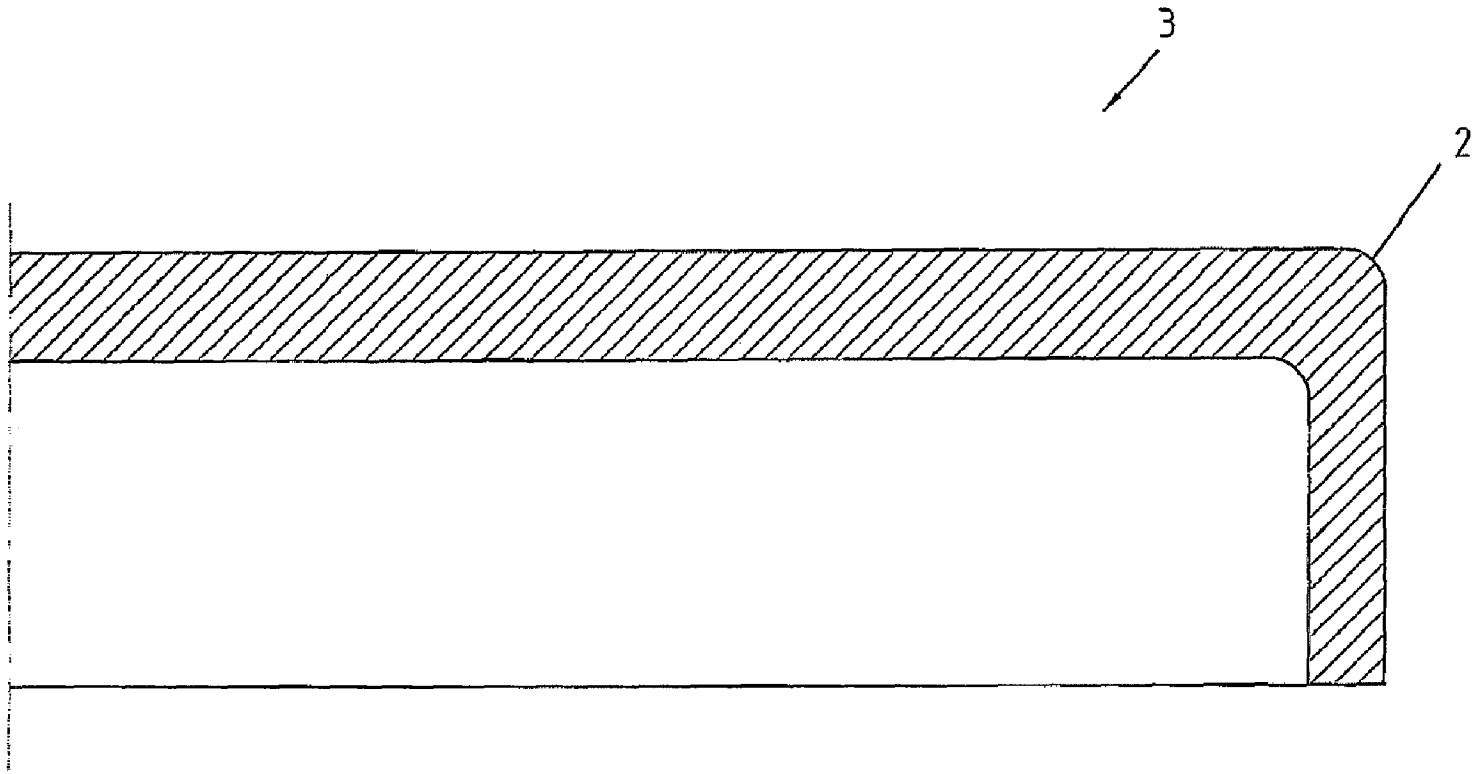
FIG. 2 shows a half section of a blank after compression.
Figure 3:
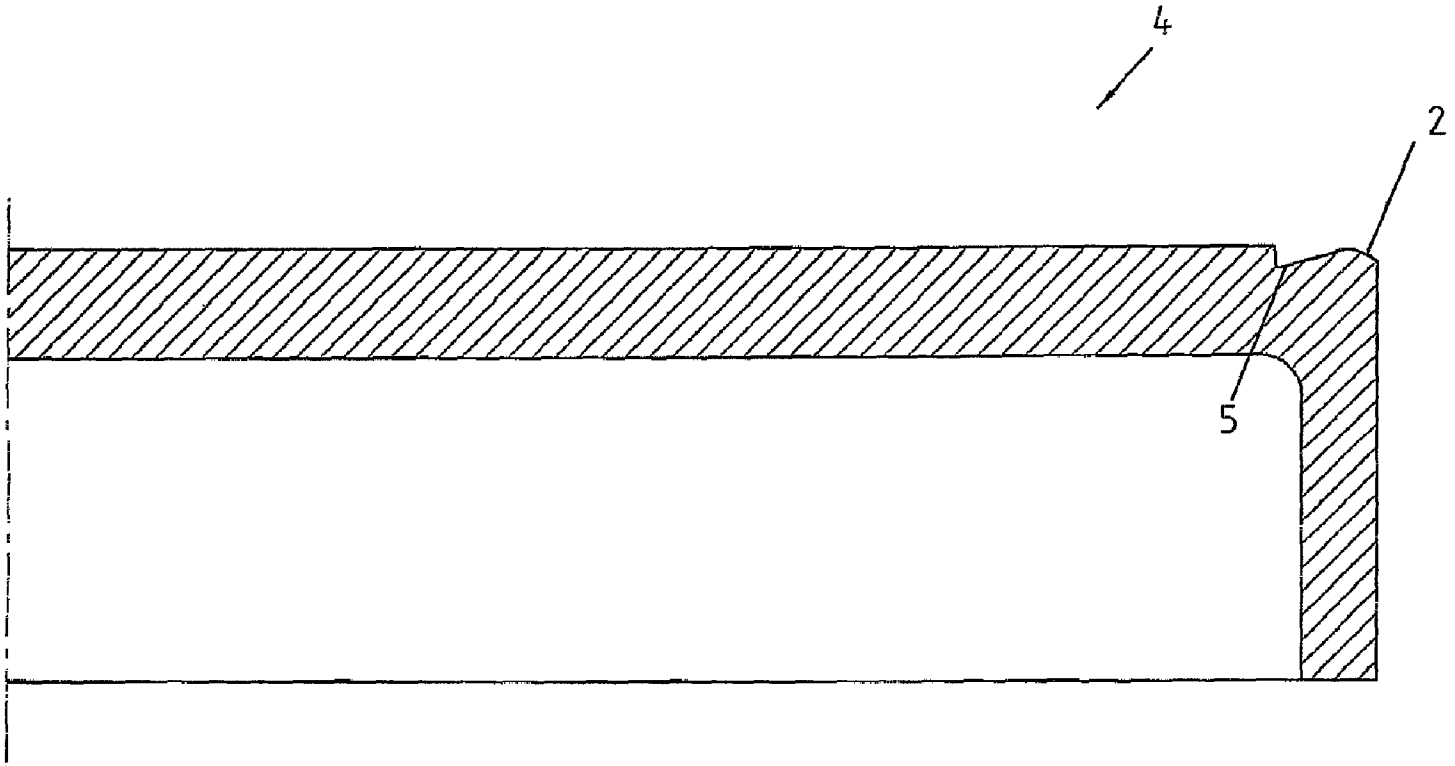
FIG. 3 shows a half section of a blank after stamping.

This state after the compression operation can be seen in FIG. 2. It can clearly be seen that there is more material in the corner region 2 of the compressed blank 3 than was the case prior to the compression. The compression is followed by further deformation, the "stamping-on". In this case, with the blank 3 compressed, material is displaced by a stamping operation into the corner region 2 by stamping. The blank 4 in which stamping has taken place is depicted in FIG. 3.

Figure 4:
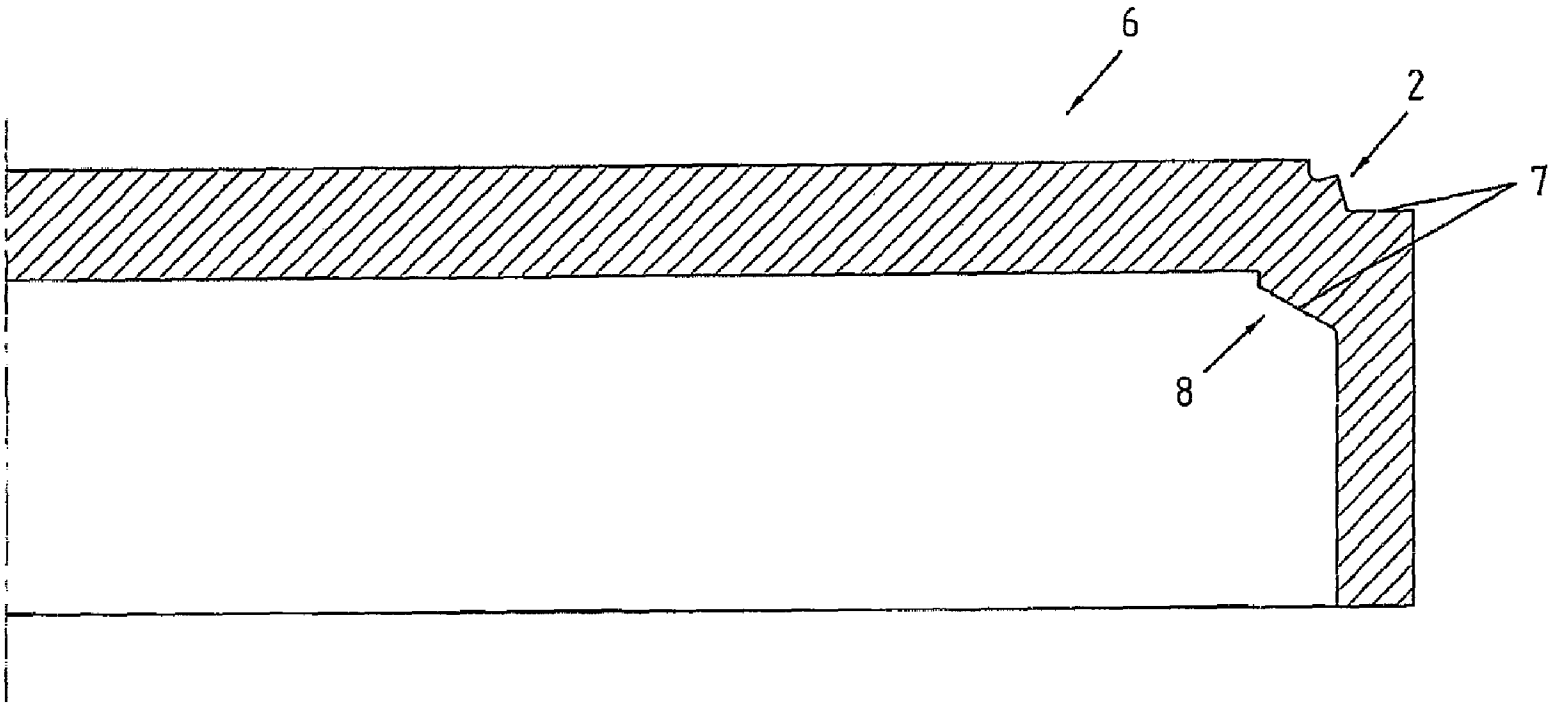

After a further stamping operation, a preformed blank 6, as can be seen in FIG. 4, is produced. Segments 7 have been stamped on both in the corner region 2 and in the inner corner region 8. These stamped-on segments 7 are of decisive importance for the subsequent rolling operation and for the formation of the grooves. The preformed blank 6, as can be seen in FIG. 4, is now supplied to the actual deformation stage of a rolling device 9.

Figure 5:
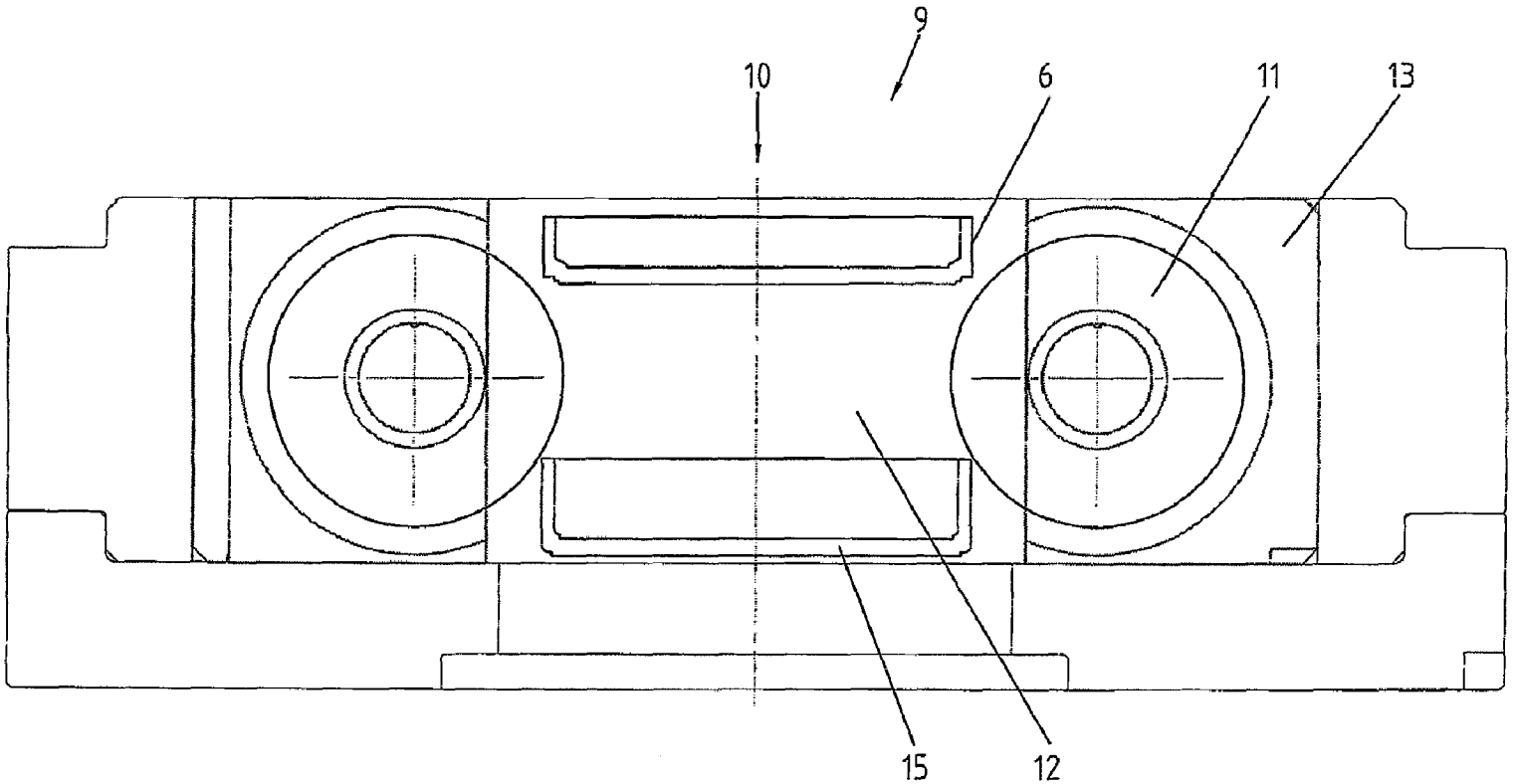
FIG. 5 shows a sectional illustration of a rolling device.
Figure 6:
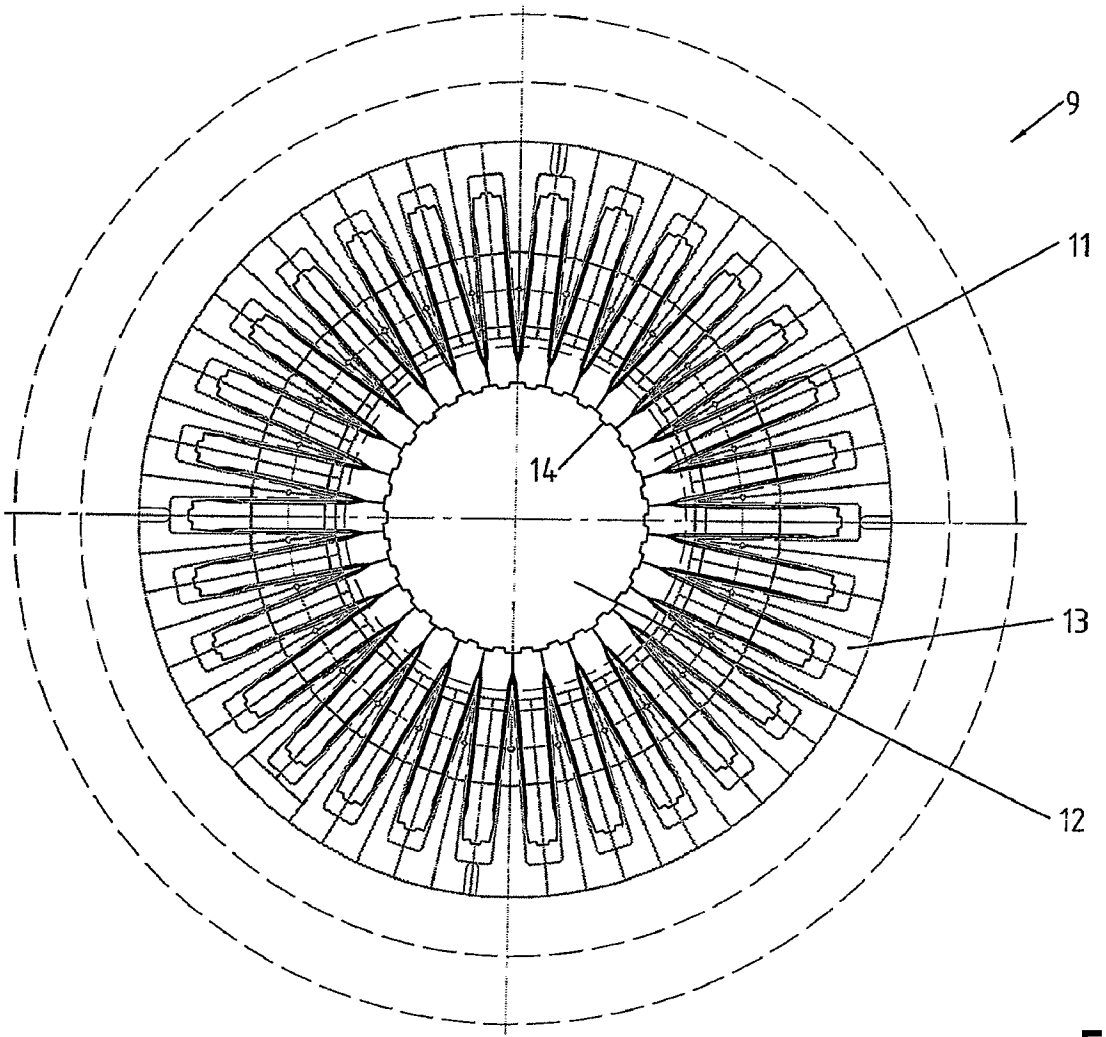
FIG. 6 shows a plan view of the rolling device.

FIG. 5 and FIG. 6 illustrate the construction of this rolling device 9. During the rolling operation, the preformed blank 6 is moved along the profiled rollers 11 in the direction of the arrow 10 by a ram (not illustrated here) during a stroke of the press. As can be seen in FIG. 6, the profile rollers 11 are arranged rotationally symmetrically along the circumference of the blank 6 to be deformed. These profiled rollers 11 are held and supported by a cage 13. The outer contour 14 of the profiled rollers 11 corresponds to the desired negative profile of the deformed blank, the workpiece 15. This profile is impressed into the blank 6 during the engagement by the profiled rollers 11.

After the workpiece 15 has been moved out of engagement of the profiled rollers 11, the desired final contour is achieved. With the return stroke of the press, the workpiece 15 is moved out of the rolling device 9 again along the profiled rollers 11 counter to the arrow 10.

Figure 7:
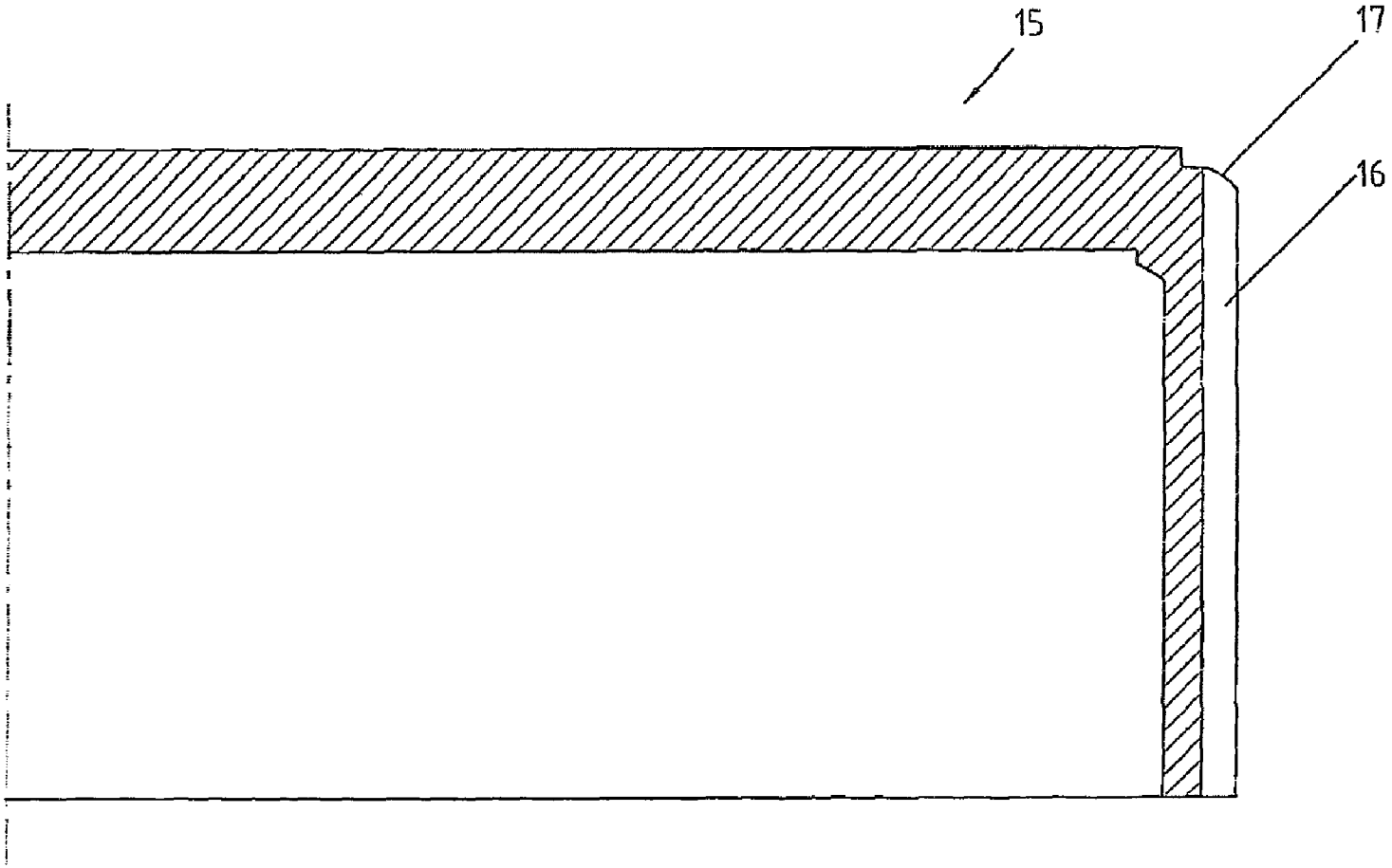
FIG. 7 shows a deformed workpiece after rolling.

FIG. 7 illustrates the workpiece 15 produced by the method according to the invention. The continuous tooth face 16 of the external toothing produced by the rolling deformation operation can clearly be seen. A crucial feature of this toothing is the configuration in the region of the tooth face beginning 17. By means of the above-described preforming methods, the tooth face 16, 17 with a very high degree of filling is produced during the subsequent rolling deformation, i.e. the usable tooth face length is increased.

The invention is not restricted to the exemplary embodiment illustrated and described. It also comprises all of the expert developments within the context of the concept according to the invention.

LIST OF REFERENCE NUMBERS

1. Blank
2. Corner region
3. Compressed blank
4. Stamped-on blank
5. Stamping
6. Preformed blank
7. Stamped-on segments
8. Inner corner region
9. Rolling device
10. Directional arrow
11. Profiled roller
12. Opening
13. Cage
14. External contour
15. Workpiece
16. Tooth face
17. Tooth face beginning

What is claimed:

1. A method of producing a cylindrical workpiece having longitudinal grooves on an outer circumferential surface thereof, said method comprising:

providing a workpiece blank having a cylindrical sidewall joined to a top wall along a corner region;

preforming the blank to transfer portions of the material of the workpiece blank into the corner region; and deforming the preformed blank to form the longitudinal grooves in the outer circumferential surface thereof by forcing the preformed blank through a plurality of concentrically arranged profiled rollers.

2. The method of claim 1, wherein the preforming method includes a stamping method.

3. The method of claim 1, wherein the preforming method includes a compression method.

4. The method of claim 1, wherein the preforming method includes a stamping method and a compression method.

5. The method of claim 1, wherein the degree to which the longitudinal grooves are formed on the outer circumferential surface of the workpiece is enhanced by the preforming step.

6. The method of claim 1, wherein the thickness of the workpiece blank is increased by performing the preforming step at a predetermined degree of deformation.

7. The method of claim 1, wherein the preforming and deforming steps are carried out on presses at the same time.

8. The method of claim 1, wherein the preforming and deforming steps are carried out in the same pressing cycle.

9. The method of claim 1, wherein the preforming and deforming steps are integrated in a pressing line and automated.

10. The method of claim 9, wherein a single workpiece transportation device is used to transport the workpiece blank to and from both the preforming and deforming steps.

11. The method of claim 1, wherein, during the deforming step, the profiled rollers extend into the portions of the material of the workpiece blank that were transferred into the corner region thereof.

* * * * *